US010670298B2

(12) United States Patent
Ikeda et al.

(10) Patent No.: US 10,670,298 B2
(45) Date of Patent: Jun. 2, 2020

(54) AIR CONDITIONER

(71) Applicant: Mitsubishi Electric Corporation, Tokyo (JP)

(72) Inventors: Takashi Ikeda, Tokyo (JP); Mitsuhiro Shirota, Tokyo (JP); Takahiro Shishido, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 138 days.

(21) Appl. No.: 15/736,817

(22) PCT Filed: Sep. 10, 2015

(86) PCT No.: PCT/JP2015/075688
§ 371 (c)(1),
(2) Date: Dec. 15, 2017

(87) PCT Pub. No.: WO2017/042926
PCT Pub. Date: Mar. 16, 2017

(65) Prior Publication Data

US 2018/0156491 A1 Jun. 7, 2018

(51) Int. Cl.
*F24F 13/08* (2006.01)
*F24F 13/14* (2006.01)
(Continued)

(52) U.S. Cl.
CPC ..... *F24F 13/1486* (2013.01); *F24F 1/0011* (2013.01); *F24F 1/0014* (2013.01); *F24F 13/085* (2013.01); *F24F 13/14* (2013.01); *F24F 13/142* (2013.01); *F24F 1/0057* (2019.02); *F24F 13/1413* (2013.01); *F24F 13/20* (2013.01); *F24F 13/222* (2013.01); *F24F 13/24* (2013.01); *F24F 2013/202* (2013.01); *F24F 2013/225* (2013.01); *F24F 2013/245* (2013.01)

(58) Field of Classification Search
CPC ..... F24F 13/085; F24F 13/1486; F24F 13/08; F24F 13/14
See application file for complete search history.

(56) References Cited

FOREIGN PATENT DOCUMENTS

CN 203375632 U 1/2014
CN 203533819 U 4/2014
(Continued)

OTHER PUBLICATIONS

Maika, Air Conditioner, Jan. 2009, Full Document (Year: 2009).*
(Continued)

*Primary Examiner* — Elizabeth J Martin
*Assistant Examiner* — Nael N Babaa
(74) *Attorney, Agent, or Firm* — Posz Law Group, PLC

(57) ABSTRACT

An air conditioner includes: a main body having an air outlet; a fan provided in the main body; a heat exchanger provided in the main body; and a first member rotatably supported on the main body and opening and closing the air outlet, wherein the first member includes a first casing having a first surface facing an inner side of the main body while operation is stopped and a second casing attached to the first casing; on the first casing, a recess is formed on the first surface and a protrusion protruding toward the second casing is formed, and the recess is positioned on an opposite side to the protrusion.

20 Claims, 9 Drawing Sheets

(51) Int. Cl.

| | |
|---|---|
| ***F24F 1/0011*** | (2019.01) |
| ***F24F 1/0014*** | (2019.01) |
| *F24F 13/24* | (2006.01) |
| *F24F 1/0057* | (2019.01) |
| *F24F 13/20* | (2006.01) |
| *F24F 13/22* | (2006.01) |

(56) References Cited

FOREIGN PATENT DOCUMENTS

| | | | | |
|---|---|---|---|---|
| CN | 104566893 | A | | 4/2015 |
| EP | 2 813 777 | A1 | | 12/2014 |
| JP | S57-064527 | U | | 4/1982 |
| JP | S64-041838 | U | | 3/1989 |
| JP | H01-063923 | U | | 4/1989 |
| JP | H10-246502 | A | | 9/1998 |
| JP | H10246502 | A | * | 9/1998 |
| JP | H11-037536 | A | | 2/1999 |
| JP | 2000-205639 | A | | 7/2000 |
| JP | 2003-21387 | A | | 1/2003 |
| JP | 2003-139379 | A | | 5/2003 |
| JP | 2005-121306 | A | | 5/2005 |
| JP | 2005121306 | A | * | 5/2005 |
| JP | 3896968 | B2 | | 1/2007 |
| JP | 2007-132578 | A | | 5/2007 |
| JP | 2007132578 | A | * | 5/2007 |
| JP | 2009-014289 | A | | 1/2009 |
| JP | 2009014289 | A | * | 1/2009 |
| JP | 2013-164218 | A | | 8/2013 |
| JP | 5359727 | B2 | | 9/2013 |
| WO | 2007/012163 | A | | 2/2007 |

OTHER PUBLICATIONS

Tatsuo, Horizontal Vane for Air Conditioner, Sep. 1998, Full Document (Year: 1998).*

International Search Report of the International Searching Authority dated Dec. 15, 2015 for the corresponding international application No. PCT/JP2015/075688 (and English translation).

Extended European Search Report dated Mar. 13, 2019 issued in corresponding EP patent application No. 15903588.0.

Office Action dated Sep. 10, 2019 issued in corresponding EP patent application No. 15 903 588.0.

Office action dated Sep. 4, 2019 issued in corresponding CN patent application No. 201580081770.6 (and English translation thereof).

* cited by examiner

AIR CONDITIONER

CROSS REFERENCE TO RELATED APPLICATION

This application is a U.S. national stage application of PCT/JP2015/075688 filed on Sep. 10, 2015, the disclosure of which is incorporated herein by reference.

TECHNICAL FIELD

The present invention relates to an air conditioner.

BACKGROUND ART

PTL 1 discloses a horizontal blade of an air conditioner, in which recesses for holding dew condensation water are provided respectively on front and back surfaces of the horizontal blade.

CITATION LIST

Patent Literature

[PTL 1] Japanese Patent Application Publication No. H10-246502

SUMMARY OF INVENTION

Technical Problem

A blade provided in an air conditioner to control wind direction has a problem in that, when flow separates from the blade during operation, wind direction controllability declines. In addition, since air conditioners are often installed in a living space and a space in which service is provided, maintaining superior design thereof is an important issue.

The present invention has been made in consideration of the above, and an object thereof is to provide an air conditioner capable of achieving both superior design and wind direction controllability.

Solution to Problem

In order to achieve the object described above, an air conditioner according to the present invention includes: a main body having an air outlet; a fan provided in the main body; a heat exchanger provided in the main body; and a first member rotatably supported on the main body and opening and closing the air outlet, wherein the first member includes a first casing having a first surface facing an inner side of the main body while operation is stopped and a second casing attached to the first casing; on the first casing, a recess is formed on the first surface and a protrusion protruding toward the second casing is formed, and the recess is positioned on an opposite side to the protrusion.

Advantageous Effects of Invention

According to the present invention, both superior design and wind direction controllability can be achieved.

DESCRIPTION OF EMBODIMENTS

Figure 1:
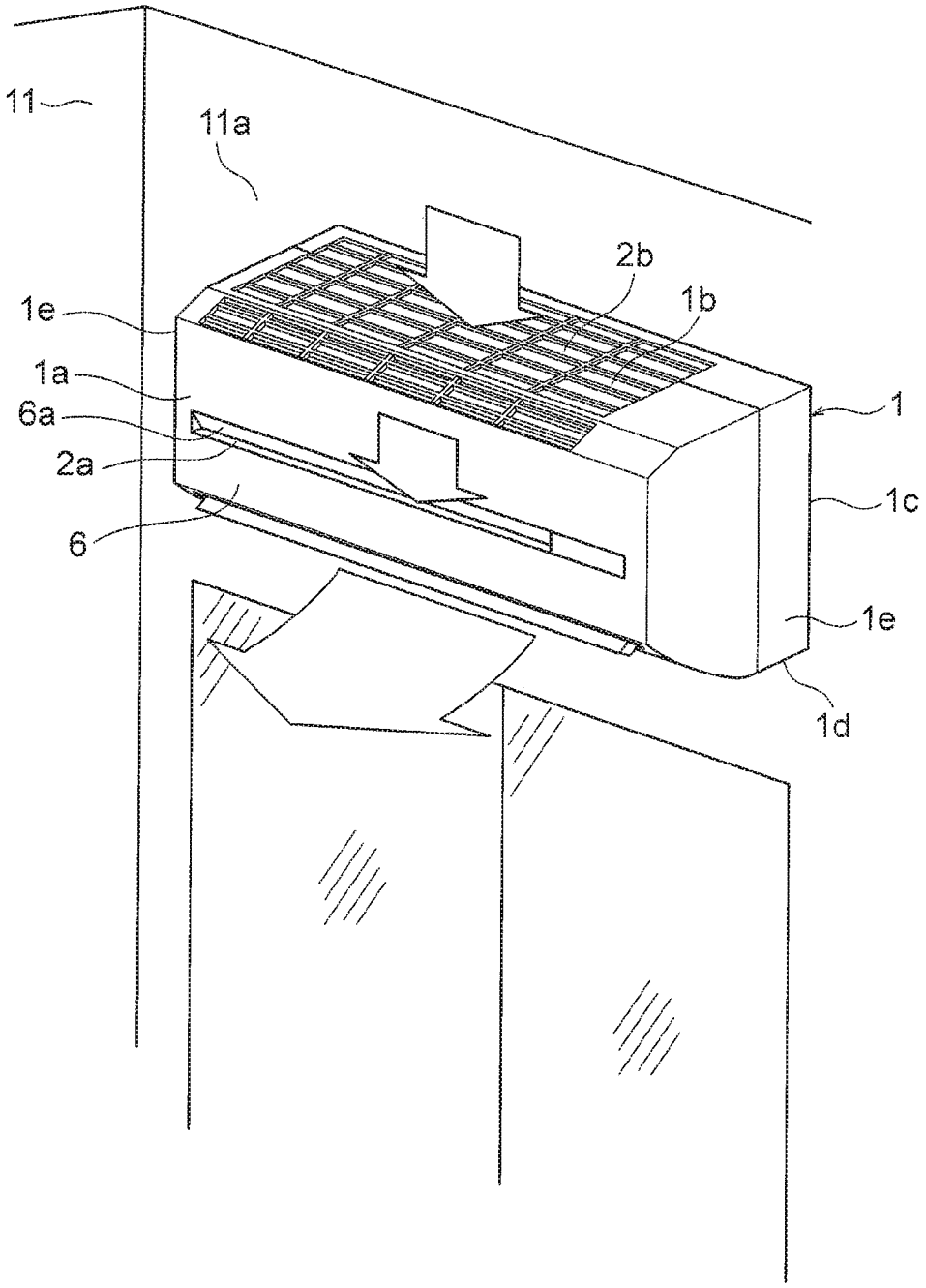
FIG. 1 shows an installed state view of an air conditioner representing a first embodiment of the present invention.

Hereinafter, embodiments of an air conditioner (an indoor unit) according to the present invention will be described with reference to the accompanying drawings. It is to be understood that same reference signs in the drawings denote same or corresponding portions. In addition, existing products can be used as outdoor units.

First Embodiment

Figure 2:
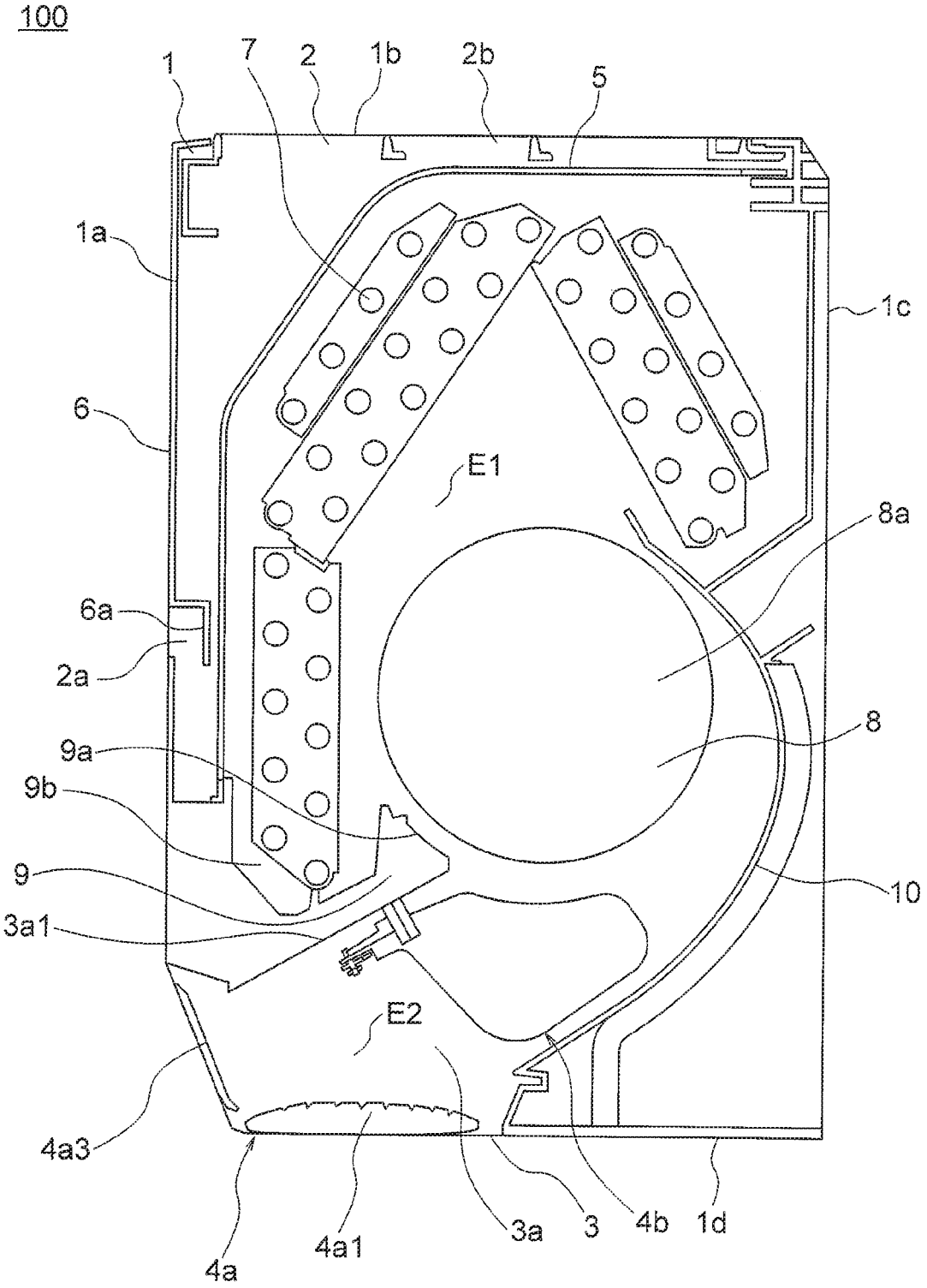
FIG. 2 shows a side view of an internal structure of the air conditioner shown in FIG. 1.
Figure 3:
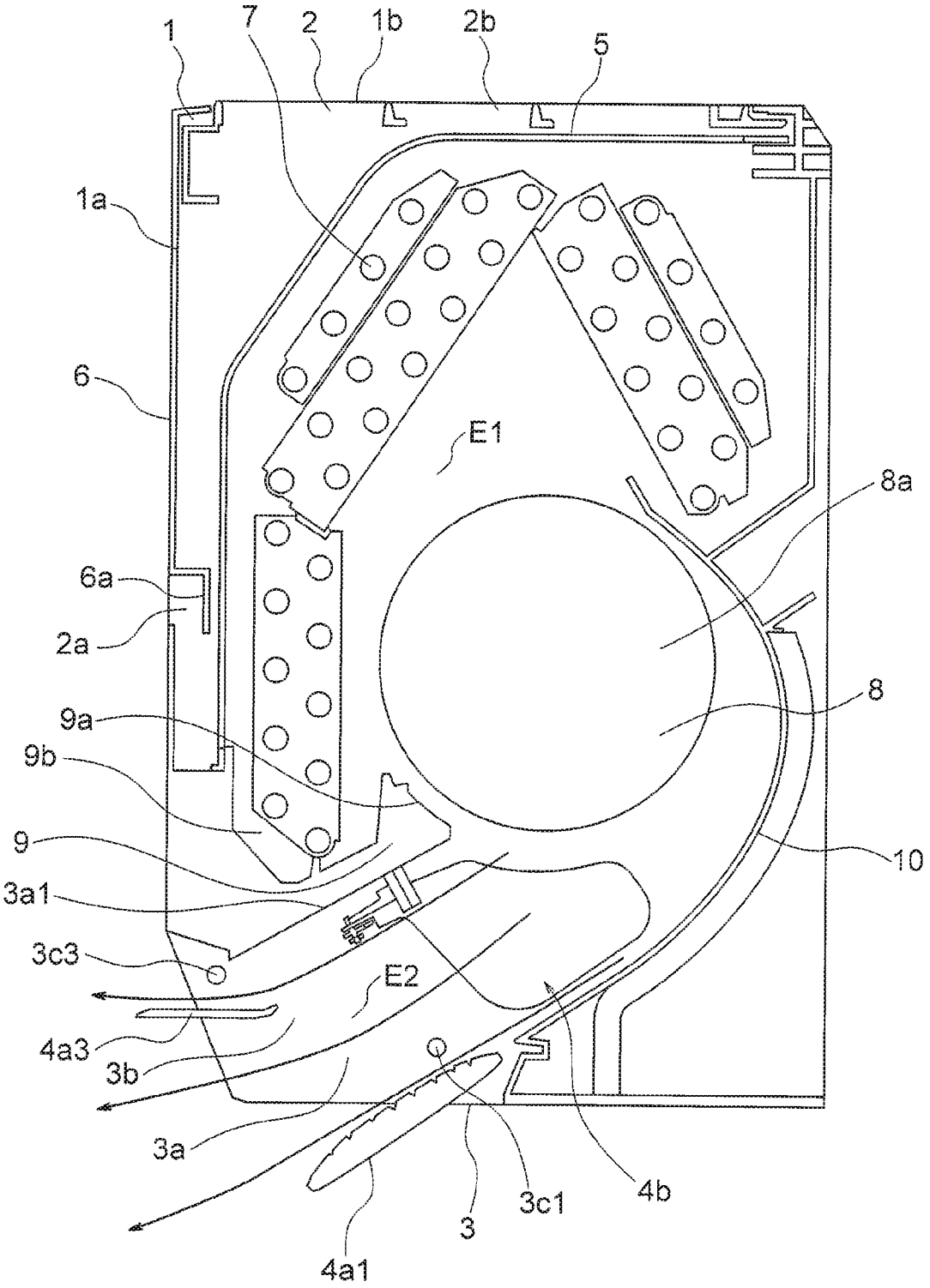
FIG. 3 shows a side view of an internal structure of the air conditioner shown in FIG. 1.
Figure 4:
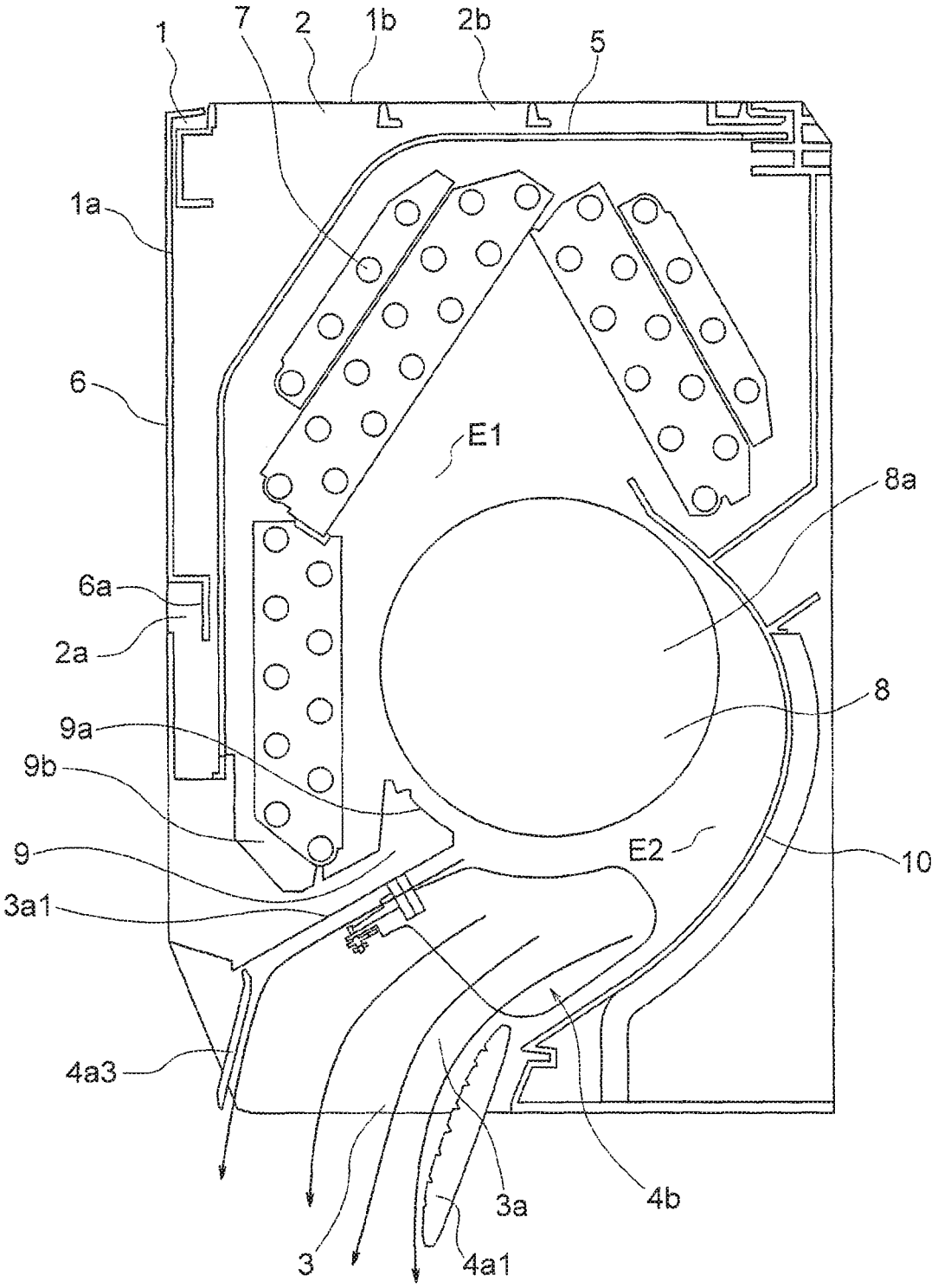
FIG. 4 shows a side view of an internal structure of the air conditioner shown in FIG. 1.

FIG. 1 shows a schematic installation of an air conditioner according to a first embodiment of the present invention as viewed from a room. FIG. 2 to FIG. 4 show a side view of an internal structure of the air conditioner shown in FIG. 1.

Moreover, FIG. 2 shows a state in which operation of the air conditioner is stopped, FIG. 3 shows a state during a horizontal blowing operation (during front blowing), and FIG. 4 shows a state during a downward blowing operation (during vertical blowing).

As illustrated in FIG. 1, in an air conditioner (indoor unit) 100, a main body 1 constitutes an outer housing of the air conditioner 100. The air conditioner 100 is a wall-mounted air conditioner and is installed on a wall 11*a* of a room 11 that is a space to be air-conditioned. In addition, the air conditioner 100 is not limited to being installed in a room of a general household and may be installed in, for example, a room of a building of a facility or a warehouse.

The main body 1 has a box shape and includes a back surface 1*c* opposing the wall 11*a* of the room 11, a front surface 1*a* on an opposite side to the back surface 1*c*, an upper surface 1*b*, a lower surface 1*d*, and a pair of left and right side surfaces 1*e*.

A grill-like suction port 2*b* for sucking indoor air into the air conditioner 100 is formed on the upper surface 1*b* that constitutes an upper part of the main body 1. In addition, a front grill 6 is attached to the front surface 1*a*, and a suction port 2*a* opens at a central part of the front grill 6 in a height direction of the main body. The suction port 2*a* extends in a lateral width direction of the front grill 6. An air guide wall 6*a* is provided on a downstream side of the suction port 2*a*. A front surface side of a flow passage on the downstream side of the suction port 2*a* is formed by a back surface of the front grill 6, and a back surface side of the flow passage on the downstream side of the suction port 2*a* is formed by the air guide wall 6*a*. The air guide wall 6*a* extends toward a back surface side from the front grill 6 above the suction port 2*a* and also extends downward.

An air outlet 3 for supplying conditioned air into a room is formed on the lower surface 1*d* that constitutes a lower part of the main body 1. More precisely, the air outlet 3 is formed so as to straddle an area between an area of a front part of the lower surface 1*d* and an area of a lower part of the front surface 1*a*. The lower part of the front surface 1*a* is a surface which faces the front in approximately the same manner as a central part and an upper part of the front surface 1*a*, which occupy a major portion of the front surface 1*a*, and the lower part of the front surface 1*a* is inclined slightly more downward than the central part and the upper part of the front surface 1*a*.

A cross-flow fan (an air blowing section) 8 having an impeller 8*a* and a guide wall 10 are arranged inside the main body 1. The cross-flow fan 8 is arranged between a suction-side air passage E1 and an outlet-side air passage E2, and sucks in air from the suction ports 2*a* and 2*b* and blows air to the air outlet 3. The guide wall 10 extends from behind to below the cross-flow fan 8 and guides air discharged from the cross-flow fan 8 to the air outlet 3.

In addition, inside the main body 1, a filter (a ventilation resistor) 5 that removes dust and the like in air sucked in from the suction ports 2*a* and 2*b*, a heat exchanger (a heat exchanging section, a ventilation resistor) 7 that transmits hot heat or cold heat of a refrigerant to air and generates air-conditioned air, and a stabilizer 9 that partitions the interior of the main body 1 into the suction-side air passage E1 and the outlet-side air passage E2 are also arranged.

The guide wall 10 constitutes the outlet-side air passage E2 together with a lower surface-side of the stabilizer 9. The guide wall 10 forms a spiral surface from the cross-flow fan 8 to the air outlet 3.

The filter 5 is, for example, mesh-patterned and removes dust and the like in the air that is sucked in from the suction ports 2*a* and 2*b*. The filter 5 is provided on a downstream side of the suction ports 2*a* and 2*b* and an upstream side of the heat exchanger 7 in an air passage from the suction ports 2*a* and 2*b* to the air outlet 3. In addition, the filter 5 extends from above to front of the heat exchanger 7.

The heat exchanger 7 (an indoor heat exchanger) functions as an evaporator to cool air during a cooling operation and functions as a condenser (a radiator) to heat air during a heating operation. The heat exchanger 7 is provided on a downstream side of the filter 5 and an upstream side of the cross-flow fan 8 in the air passage (a central part of the inside of the main body 1) from the suction ports 2*a* and 2*b* to the air outlet 3. Moreover, while the heat exchanger 7 is shaped in FIG. 2 so as to enclose the cross-flow fan 8 from a front part and an upper part thereof, this shape is merely an example and the shape of the heat exchanger 7 is not particularly limited.

The heat exchanger 7 constitutes a refrigerating cycle by being connected to an outdoor unit that may be in a known mode having a compressor, an outdoor heat exchanger, a diaphragm apparatus, and the like. In addition, for example, a cross fin-type fin and tube heat exchanger constituted by a heat transfer tube and a large number of fins is used as the heat exchanger 7.

The stabilizer 9 partitions the interior of the main body 1 into the suction-side air passage E1 and the outlet-side air passage E2 and is provided below the heat exchanger 7 as illustrated in FIG. 2. The suction-side air passage E1 is positioned above the stabilizer 9 and the outlet-side air passage E2 is positioned below the stabilizer 9.

The stabilizer 9 includes a tongue section 9*a* that separates the suction-side air passage E1 and the outlet-side air passage E2 from each other, a drain pan 9*b* that temporarily stores water droplets dripped from the heat exchanger 7, and a diffuser 3*a*1 constituting an upper wall surface (a front surface-side wall surface) of an outlet air passage 3*a* of the air outlet 3.

The outlet air passage 3*a* is provided with a vertical wind direction vane 4*a* and a horizontal wind direction vane 4*b*. The horizontal wind direction vane 4*b* is rotatably provided between the vertical wind direction vane 4*a* and the cross-flow fan 8. The vertical wind direction vane 4*a* is for adjusting a vertical direction from among directions of air blown out from the cross-flow fan 8, and the horizontal wind direction vane 4*b* is for adjusting a horizontal direction from among the directions of air blown out from the cross-flow fan 8.

The vertical wind direction vane 4*a* includes a first blade 4*a*1 as a first member and a second blade 4*a*3 as a second member. The first blade 4*a*1 and the second blade 4*a*3 each have a separate drive source and are individually rotated. Specifically, the second blade 4*a*3 is rotatably supported on the main body by a rotary shaft that differs from a rotary shaft of the first blade 4*a*1.

While operation is stopped, the first blade 4*a*1 closes the area of the front part of the lower surface 1*d* in the air outlet 3 and constitutes an outer surface of an apparatus body. In other words, the first blade 4*a*1 doubles as a wind direction control section and a main-body outer-housing design section. An upper surface (an air passage-side surface) of the first blade 4*a*1 while operation is stopped is formed in a protruding surface shape.

While operation is stopped, the second blade 4*a*3 closes the area of the lower part of the front surface 1*a* in the air outlet 3 and constitutes an outer surface of the apparatus body. In other words, the second blade 4*a*3 also doubles as a wind direction control section and a main-body outer-housing design section.

Figure 5:
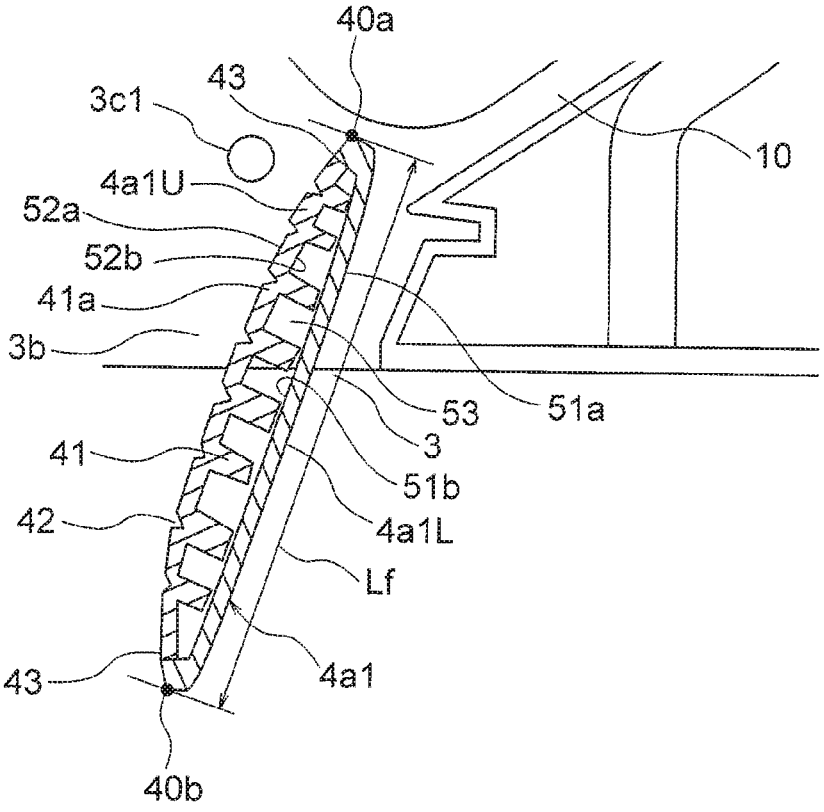
FIG. 5 shows an enlarged cross section of a first blade relates to FIG. 4.
Figure 6:
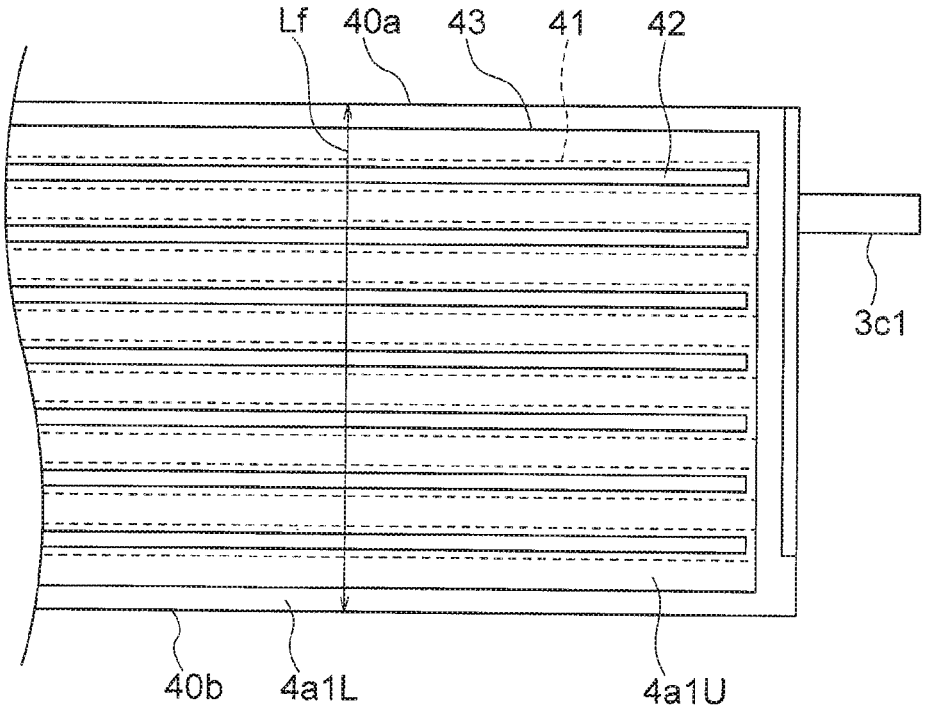
FIG. 6 shows the first blade from a first surface.

Next, details of the first blade 4*a*1 will be described. FIG. 5 shows an enlarged cross section of a first blade which relates to FIG. 4. FIG. 6 shows the first blade from a first surface. The first blade 4*a*1 is pivotally supported by a rotary shaft 3*c*1 and is provided so as to be rotatable. The rotary shaft 3*c*1 is provided in a region below the air outlet of an air outlet-side wall 3*b*. In addition, the rotary shaft 3*c*1 is positioned on a first surface side (to be described later) instead of a second surface side (to be described later) of the first blade 4*a*1. Moreover, the second blade 4*a*3 is pivotally supported by a rotary shaft 3*c*3 in a region above the air outlet and is provided so as to be rotatable.

The first blade 4*a*1 includes a first casing 4*a*1U and a second casing 4*a*1L. An outer surface of the first casing 4*a*1U includes a first surface 52*a* and an outer surface of the second casing 4*a*1L includes a second surface 51*a*. The first surface 52*a* is a surface that faces an inner side of the main body while operation is stopped and the second surface 51*a* constitutes a part of the outer surface of the main body (a part of a design surface of the main body) while operation is stopped. A hollow region 53 is formed between an inner surface 52*b* of the first casing 4*a*1U and an inner surface 51*b* of the second casing 4*a*1L. A plurality of protrusions 41 are provided on the inner surface 52*b* of the first casing 4*a*1U. Recesses 42 are provided on the first surface 52*a* of the first casing 4*a*1U. The recesses 42 are positioned on opposite sides to the protrusions 41 in an inward-outward direction of the first casing 4*a*1U.

The first blade 4*a*1 is formed in a wing shape with a blade chord length of Lf. The first blade 4*a*1 has an inlet end 40*a* that is a front edge and an outlet end 40*b* that is a rear edge. For example, the inlet end 40*a* and the outlet end 40*b* are both provided on the second casing 4a1L. The first blade 4a1 has a pair of fitting lines 43 that constitutes a boundary between the second casing 4a1L and the first casing 4a1U. The pair of fitting lines 43 is positioned further toward a side of the first surface 52a than a blade chord as viewed in a cross section shown in FIG. 5 or, in other words, a cross section having the rotary shaft 3c1 of the first blade 4a1 as a perpendicular line.

The first blade 4a1 has a hollow integrated structure in which the second casing 4a1L and the first casing 4a1U are fitted, bonded, or welded to each other at the fitting lines 43. In addition, the first blade 4a1 has a shape that tapers toward each of the inlet end 40a and the outlet end 40b.

Each of the protrusions 41 is a reinforcement rib extending in a front-back direction of the paper surface of FIG. 5. In addition, tips of all the protrusions 41 may abut against the inner surface 51b of the second casing 4a1L, only the tips of a part of the protrusions 41 may abut against the inner surface 51b of the second casing 4a1L, or the tips of all the protrusions 41 may not abut against the inner surface 51b of the second casing 4a1L.

In addition, the plurality of protrusions 41 are arranged in a blade chord direction at intervals and in the blade chord direction as viewed in the cross section shown in FIG. 5.

Each of the plurality of recesses 42 is arranged at a position corresponding to a root section 41a of a corresponding protrusion 41.

The air conditioner according to the present first embodiment configured as described above attains the following advantages. First, a blade provided in an air conditioner to control wind direction has a problem in that, when flow separates from the blade during operation, wind direction controllability declines. Therefore, the blade that controls wind direction may be configured so as to have a certain thickness and a curve to which flow readily conforms. Furthermore, since the blade that controls wind direction moves frequently during operation, weight reduction is favorably achieved while retaining a thick configuration. In addition, since air conditioners are often installed in a living space and a space in which service is provided, maintaining superior design is an important issue. In consideration of the above, from the perspective of preventing separation, by providing recesses over an entire blade that controls wind direction, generation of negative pressure by the recesses can be expected, thereby reducing occurrences of separation and preventing a decline in wind direction controllability. In addition, from the perspective of thickly forming the blade that controls wind direction and reducing weight of the blade, making the blade hollow allows both prevention of separation due to securing thickness and a reduction in weight to be achieved.

However, providing recesses over the entire blade that controls wind direction may make the recesses provided on a surface constituting an outer surface of the main body visible to a user while operation is stopped and may impair superior design. In consideration thereof, in the present first embodiment, the blade that controls wind direction is provided with recesses only on a surface that faces an inner side of the main body while operation is stopped. Accordingly, both superior design and favorable wind direction controllability can be achieved. In addition, since providing recesses on a blade having a hollow structure causes a reduction in strength, problems of vibration and noise of the blade may arise due to pressure of outlet air and a drive force for changing attitude acting on the blade. In consideration thereof, in the present first embodiment, protrusions are provided in an inner part of the blade having a hollow structure and, at the same time, recesses provided only on a surface that faces an inner side of the main body while operation is stopped are arranged on an opposite side to root sections of the protrusions. Accordingly, with securing thickness, weight reduction, suppression of reduction in strength, prevention of decline in design superiority, and the like being able to be realized at the same time, suppression of vibration and noise, securing of wind direction controllability, and prevention of decline in design superiority can all be achieved.

In addition, the first blade is constituted by the second casing and the first casing to obtain a hollow structure without incurring excessive cost in the present first embodiment, and the pair of fitting lines is positioned further toward a side of the first surface than the blade chord. In other words, since the fitting lines are not visible from the outer side of the main body while operation of the air conditioner is stopped, design superiority is further improved. Furthermore, even in an unlikely event that dew condensation occurs on a side of the first surface of the first casing of the first blade, since water is held at the fitting lines, prevention of water dripping can be expected.

In the present first embodiment, since protrusions are provided not on the second casing but on the first casing, the protrusions not only contribute to securing strength of the hollow structure but are also capable of suppressing thermal deformation of the first casing that is exposed to temperature variation between heating and cooling.

Second Embodiment

Figure 7:
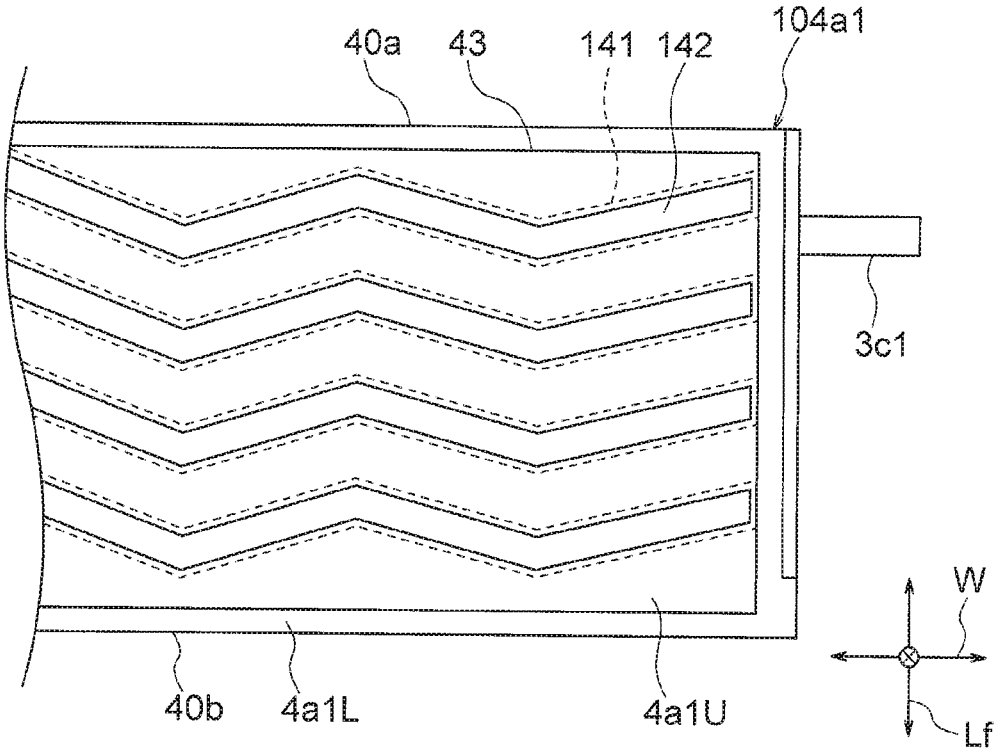
FIG. 7 shows a second embodiment of the present invention and which shows the same mode as FIG. 6.

Next, a second embodiment of the present invention will be described with reference to FIG. 7. FIG. 7 shows a second embodiment of the present invention and which shows a same mode as FIG. 6. A configuration of the present second embodiment is similar to that in the first embodiment described above with the exception of the portions described below.

In the first embodiment described above, the protrusions 41 and the recesses 42 linearly extend parallel to the direction in which the rotary shaft 3c1 of the first blade 4a1 extends. In contrast, in the present second embodiment, protrusions 141 and recesses 142 of a first blade 104a1 extend so as to be inclined with respect to a direction in which the rotary shaft 3c1 extends as viewed in FIG. 7 or, in other words, as viewed from a direction perpendicular to both a blade chord (Lf) and a blade width (W). More specifically, the protrusions 141 and the recesses 142 extend so as to curve or bend in a wave shape, a U-shape, a V-shape, or a W-shape. FIG. 7 shows an example in which the protrusions 141 and the recesses 142 extend so as bend in a W-shape.

In the present second embodiment as well, advantages similar to those of the first embodiment described above are attained. In addition, in the present second embodiment, since the recesses consecutively zigzag with respect to the rotary shaft in the direction in which the rotary shaft extends, even when there is a difference in wind velocity in the rotary shaft direction, flow is diffused by the recesses and wind velocity is uniformized, thereby making separation less likely to occur. Furthermore, due to the flow conforming to the first surface of the first casing, ingress of cool air to the first surface attributable to a separation vortex can be suppressed, dew condensation can be prevented, and a high-quality air conditioner can be obtained.

Third Embodiment

Figure 8:
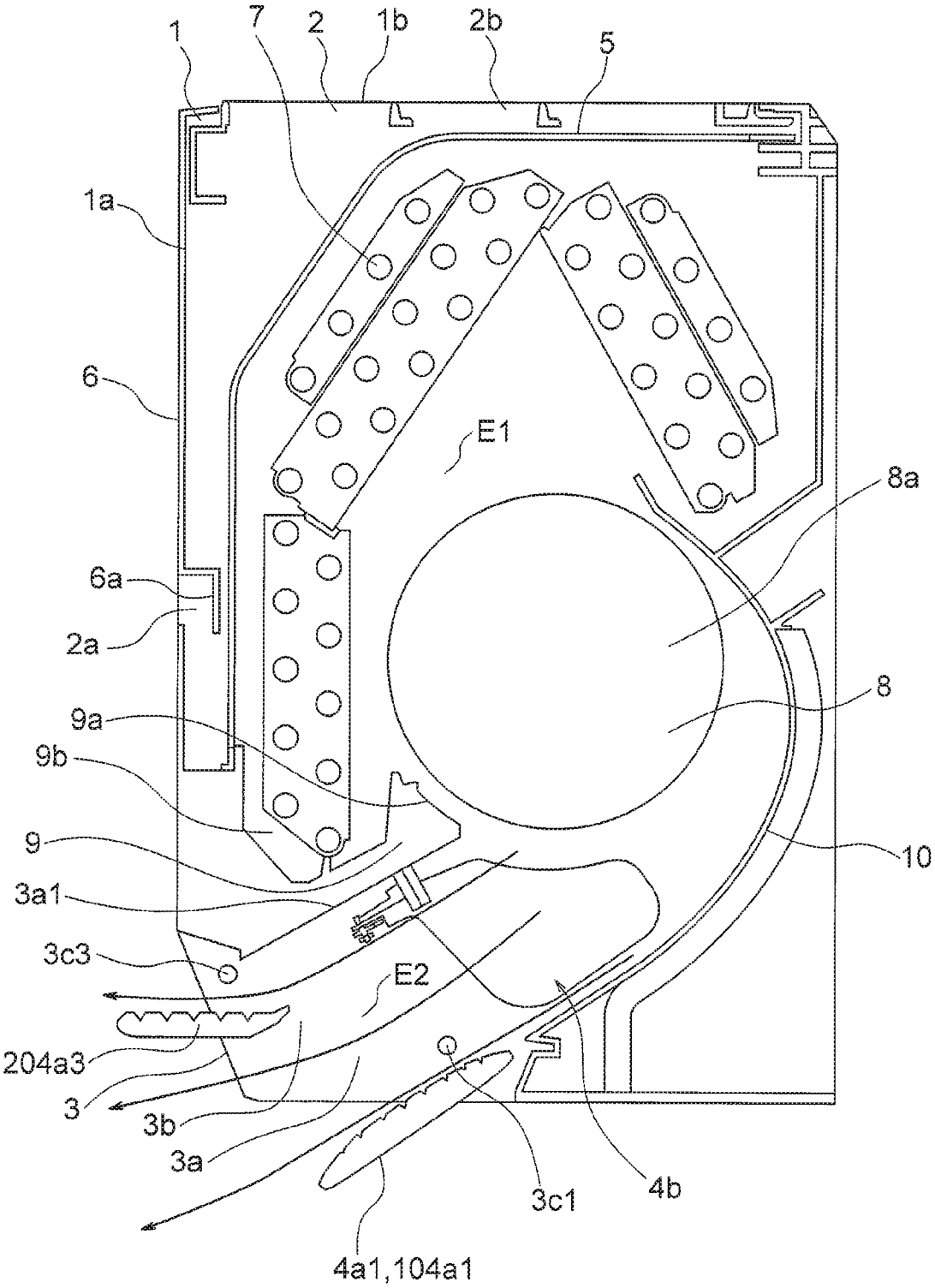
FIG. 8 shows a third embodiment of the present invention and which shows the same mode as FIG. 2.
Figure 9:
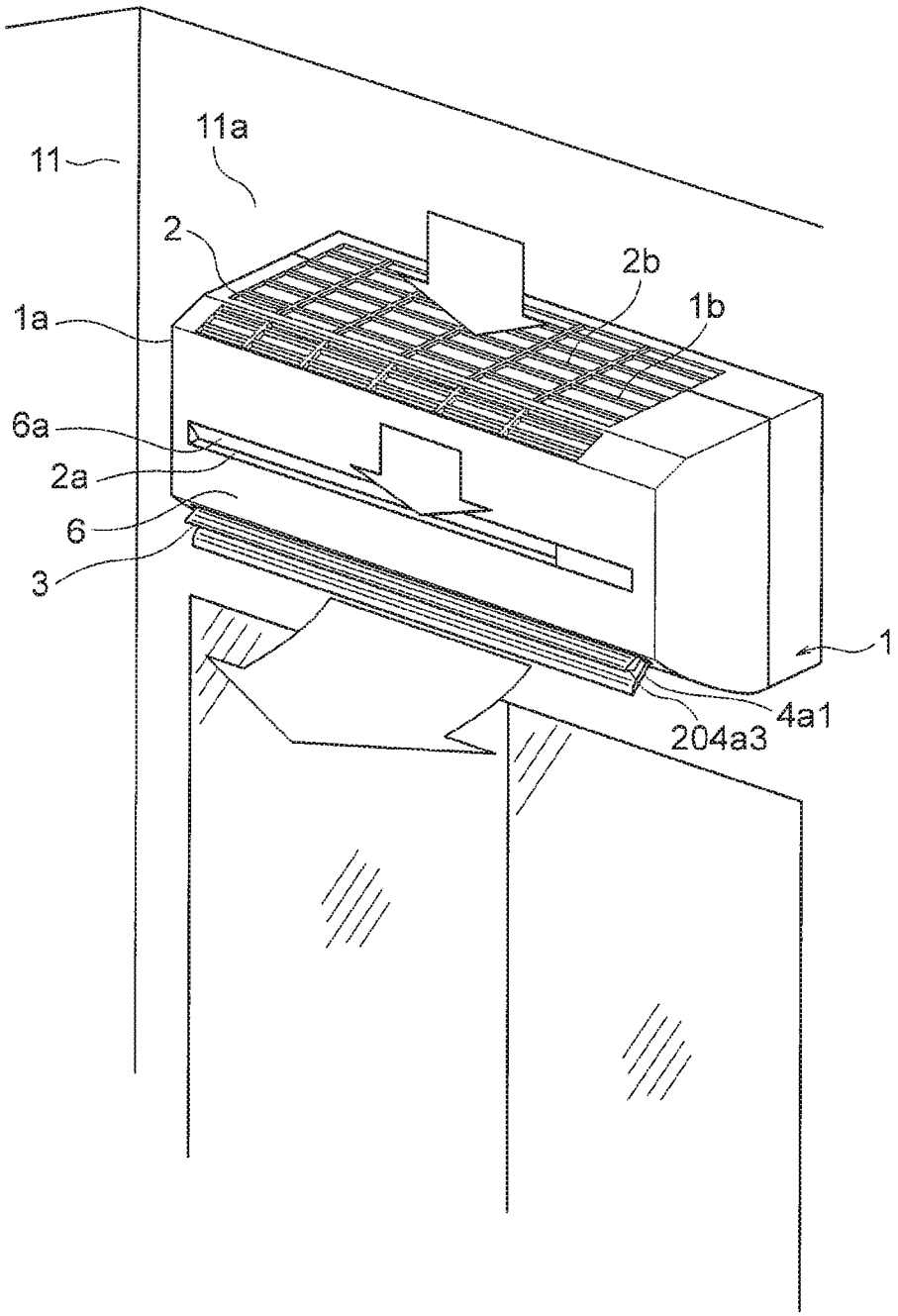
FIG. 9 shows the third embodiment of the present invention and which shows the same mode as FIG. 1.

Next, a third embodiment of the present invention will be described with reference to FIG. 8 and FIG. 9. FIG. 8 shows a third embodiment of the present invention and which shows a same mode as FIG. 2. FIG. 9 shows a third embodiment of the present invention and which shows a same mode as FIG. 1. A configuration of the present third embodiment is similar to that in the first or second embodiment described above with the exception of the portions described below.

In the present third embodiment, a second blade 204*a*3 that is a second member is configured in a similar manner to the first blade 4*a*1 or 104*a*1. Specifically, the second blade 204*a*3 includes a first casing and a second casing, an outer surface of the first casing of the second blade 204*a*3 includes a first surface, and an outer surface of the second casing of the second blade 204*a*3 includes a second surface. The first surface of the second blade 204*a*3 is a surface that faces an inner side of the main body while operation is stopped and the second surface of the second blade 204*a*3 constitutes a part of the outer surface of the main body (a part of a design surface of the main body) while operation is stopped. A hollow region is formed between an inner surface of the first casing of the second blade 204*a*3 and an inner surface of the second casing of the second blade 204*a*3. Protrusions are provided on the inner surface of the first casing of the second blade 204*a*3 and recesses are provided on the first surface of the second blade 204*a*3. The recesses of the second blade 204*a*3 are positioned on an opposite side to the protrusions in an inward-outward direction of the first casing of the second blade 204*a*3. The recesses may extend in the direction, in which the rotary shaft 3*c*1 extends, in a similar manner to the first blade 4*a*1 or may extend so as to consecutively zigzag with respect to the rotary shaft 3*c*1 in the direction, in which the rotary shaft 3*c*1 extends, in a similar manner to the first blade 104*a*1.

In the present third embodiment as well, advantages similar to those of the first embodiment or the second embodiment described above are attained. In addition, since the first blade 4*a*1, 104*a*1 and the second blade 204*a*3 are all configured as described above in the present third embodiment, advantages of the first or second embodiment described above are attained in a more prominent manner.

Fourth Embodiment

Figure 10:
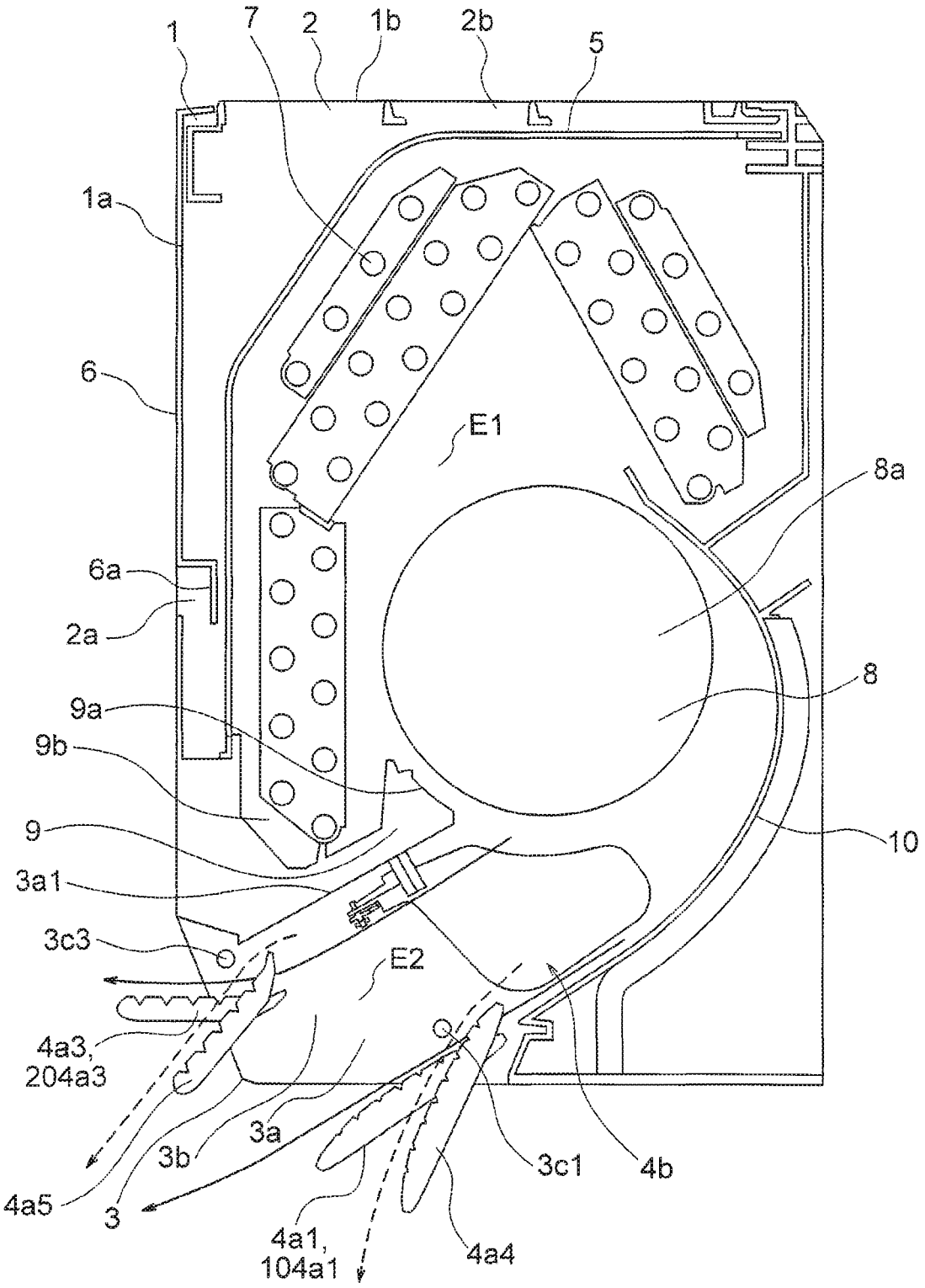
FIG. 10 shows a fourth embodiment of the present invention and which shows a same mode as FIG. 2.

Next, a fourth embodiment of the present invention will be described with reference to FIG. 10. FIG. 10 shows a fourth embodiment of the present invention and which shows a same mode as FIG. 2. A configuration of the present fourth embodiment is similar to that in the first, second, or third embodiment described above with the exception of the portions described below.

The present fourth embodiment further includes a third blade 4*a*4 that is a third member and a fourth blade 4*a*5 that is a fourth member. The third blade 4*a*4 is configured in a similar manner to the first blade 4*a*1 or 104*a*1 and the fourth blade 4*a*5 is configured in a similar manner to the second blade 4*a*3 or 204*a*3. The third blade 4*a*4 is arranged side by side with the first blade 4*a*1 or 104*a*1 in a direction in which the rotary shaft of the first blade 4*a*1 or 104*a*1 extends, and the third blade 4*a*4 is rotatably supported by the main body and opens and closes the air outlet. The fourth blade 4*a*5 is arranged side by side with the second blade 4*a*3 or 204*a*3 in a direction in which the rotary shaft of the second blade 4*a*3 or 204*a*3*a* extends, and the fourth blade 4*a*5 is rotatably supported by the main body and opens and closes the air outlet. In other words, in addition to the configuration of the first embodiment, the second embodiment, or the third embodiment described above, the air conditioner according to the present fourth embodiment includes the third blade 4*a*4 which is rotatably supported by the main body and which opens and closes the air outlet. The third blade 4*a*4 includes a first casing and a second casing. An outer surface of the first casing of the third blade 4*a*4 includes a first surface and an outer surface of the second casing of the third blade 4*a*4 includes a second surface. The first surface of the third blade 4*a*4 is a surface that faces an inner side of the main body while operation is stopped and the second surface of the third blade 4*a*4 constitutes a part of the outer surface of the main body (a part of a design surface of the main body) while operation is stopped. A hollow region is formed between an inner surface of the first casing of the third blade 4*a*4 and an inner surface of the second casing of the third blade 4*a*4. Protrusions are provided on the inner surface of the first casing of the third blade 4*a*4 and recesses are provided on the first surface of the third blade 4*a*4. The recesses of the third blade 4*a*4 are positioned on an opposite side to the protrusions in an inward-outward direction of the first casing of the third blade 4*a*4. The air conditioner according to the present fourth embodiment further includes the fourth blade 4*a*5 which is rotatably supported by the main body and which opens and closes the air outlet. The fourth blade 4*a*5 includes a first casing and a second casing. An outer surface of the second casing of the fourth blade 4*a*5 includes a second surface and an outer surface of the first casing of the fourth blade 4*a*5 includes a first surface. The first surface of the fourth blade 4*a*5 is a surface that faces an inner side of the main body while operation is stopped and the second surface of the fourth blade 4*a*5 constitutes a part of the outer surface of the main body (a part of a design surface of the main body) while operation is stopped. A hollow region is formed between an inner surface of the second casing of the fourth blade 4*a*5 and an inner surface of the first casing of the fourth blade 4*a*5. Protrusions are provided on the inner surface of the first casing of the fourth blade 4*a*5 and recesses are provided on the first surface of the fourth blade 4*a*5. The recesses of the fourth blade 4*a*5 are positioned on an opposite side to the protrusions in an inward-outward direction of the first casing of the fourth blade 4*a*5. The third blade 4*a*4 is arranged side by side with the first blade 4*a*1 or 104*a*1 in a direction in which the rotary shaft 3*c*1 of the first blade 4*a*1 or 104*a*1 extends, and the fourth blade 4*a*5 is arranged side by side with the second blade 4*a*3 or 204*a*3 in a direction in which the rotary shaft 3*c*3 of the second blade 4*a*3 or 204*a*3 extends.

In the present fourth embodiment as well, advantages similar to those of the first embodiment, the second embodiment, or the third embodiment described above are attained. In addition, in the present fourth embodiment, since wind direction plates of the hollow structure are divided to the left and right, dew condensation does not occur during cooling even when a wind direction angle is increased and a vertical wind direction angle can be increased. Furthermore, a wind direction angle can also be increased during heating, air conditioning of a floor surface and air conditioning of an upper region of a room can be performed at the same time, and comfortability can be improved.

Although a mode including the first member, the second member, the third member, and the fourth member has been exemplified in the specific description of the fourth embodiment above, the present fourth embodiment is not limited thereto and may be implemented as a mode including only the first member, the second member, and the third member, a mode including only the first member, the second member, and the fourth member, or a mode including only the first member and the third member, among the first member, the second member, the third member, and the fourth member.

While contents of the present invention have been described specifically with reference to preferred embodiments, it is obvious to those skilled in the art to implement various changes and modifications on the basis of basic technical concepts and teachings of the present invention.

REFERENCE SIGNS LIST

1 Main body
3 Air outlet
4*a*1, 104*a*1 First blade (first member)
4*a*1L Second casing
4*a*1U First casing
40*a* Inlet end
40*b* Outlet end
41, 141 Protrusion
42, 142 Recess
43 Fitting line
51*a* Second surface
51*b* Inner surface of second casing
52*a* First surface
52*b* Inner surface of first casing
4*a*3, 204*a*3 Second blade (second member)
4*a*4 Third blade (third member)
4*a*5 Fourth blade (fourth member)
7 Heat exchanger
8 Fan

The invention claimed is:

1. An air conditioner, comprising:
a main body having an air outlet;
a fan provided in the main body;
a heat exchanger provided in the main body; and
a first member rotatably supported on the main body and opening and closing the air outlet, wherein
the first member includes a first casing having a first surface facing an inner side of the main body while operation is stopped and a second casing attached to the first casing,
a hollow region is formed between an inner surface of the first casing and an inner surface of the second casing,
the first casing includes protrusions protruding toward the second casing and recesses formed on an outer surface of the first casing, the recesses are only formed at respective positions on the outer surface of the first casing corresponding to roots of the protrusions, and
the inner surface of the second casing is flat.

2. The air conditioner according to claim 1, wherein
the second casing has a second surface constituting a part of a design surface of the main body while operation is stopped.

3. The air conditioner according to claim 1, wherein
the recess of the first member consecutively zigzag with respect to a rotary shaft of the first member in a direction in which the rotary shaft extends.

4. The air conditioner according to claim 2, wherein
the recess of the first member consecutively zigzag with respect to a rotary shaft of the first member in a direction in which the rotary shaft extends.

5. The air conditioner according to claim 1, further comprising:
a second member rotatably supported on the main body by a rotary shaft, which differs from the rotary shaft of the first member, and opening and closing the air outlet, wherein
the second member includes a first casing having a first surface facing an inner side of the main body while operation is stopped and a second casing attached to the first casing.

6. The air conditioner according to claim 2, further comprising:
a second member rotatably supported on the main body by a rotary shaft, which differs from the rotary shaft of the first member, and opening and closing the air outlet, wherein
the second member includes a first casing having a first surface facing an inner side of the main body while operation is stopped and a second casing attached to the first casing.

7. The air conditioner according to claim 3, further comprising:
a second member rotatably supported on the main body by a rotary shaft, which differs from the rotary shaft of the first member, and opening and closing the air outlet, wherein
the second member includes a first casing having a first surface facing an inner side of the main body while operation is stopped and a second casing attached to the first casing.

8. The air conditioner according to claim 5, wherein
the recess of the second member consecutively zigzag with respect to the rotary shaft of the second member in a direction in which the rotary shaft extends.

9. The air conditioner according to claim 6, wherein
the recess of the second member consecutively zigzag with respect to the rotary shaft of the second member in a direction in which the rotary shaft extends.

10. The air conditioner according to claim 7, wherein
the recess of the second member consecutively zigzag with respect to the rotary shaft of the second member in a direction in which the rotary shaft extends.

11. The air conditioner according to claim 1, further comprising: a third member arranged side by side with the first member in a direction in which the rotary shaft of the first member extends, and rotatably supported on the main body, and moreover opening and closing the air outlet, wherein
the third member includes a first casing having a first surface facing an inner side of the main body while operation is stopped and a second casing attached to the first casing.

12. The air conditioner according to claim 2, further comprising: a third member arranged side by side with the first member in a direction in which the rotary shaft of the first member extends, and rotatably supported on the main body, and moreover opening and closing the air outlet, wherein
the third member includes a first casing having a first surface facing an inner side of the main body while operation is stopped and a second casing attached to the first casing.

13. The air conditioner according to claim 3, further comprising: a third member arranged side by side with the first member in a direction in which the rotary shaft of the first member extends, and rotatably supported on the main body, and moreover opening and closing the air outlet, wherein
the third member includes a first casing having a first surface facing an inner side of the main body while operation is stopped and a second casing attached to the first casing.

14. The air conditioner according to claim 11, wherein the recess of the third member consecutively zigzag with respect to a rotary shaft of the third member in a direction in which the rotary shaft extends.

15. The air conditioner according to claim 12, wherein the recess of the third member consecutively zigzag with respect to a rotary shaft of the third member in a direction in which the rotary shaft extends.

16. The air conditioner according to claim 13, wherein the recess of the third member consecutively zigzag with respect to a rotary shaft of the third member in a direction in which the rotary shaft extends.

17. The air conditioner according to claim 5, further comprising:

a fourth member arranged side by side with the second member in a direction in which the rotary shaft of the second member extends, and rotatably supported on the main body, and moreover opening and closing the air outlet, wherein the fourth member includes a first casing having a first surface facing an inner side of the main body while operation is stopped and a second casing attached to the first casing.

18. The air conditioner according to claim 8, further comprising:

a fourth member arranged side by side with the second member in a direction in which the rotary shaft of the second member extends, and rotatably supported on the main body, and moreover opening and closing the air outlet, wherein the fourth member includes a first casing having a first surface facing an inner side of the main body while operation is stopped and a second casing attached to the first casing.

19. The air conditioner according to claim 17, wherein the recess of the fourth member consecutively zigzag with respect to a rotary shaft of the fourth member in a direction in which the rotary shaft extends.

20. The air conditioner according to claim 1, wherein the first casing has a first surface facing an inner side of the main body while operation is stopped, and the recess is formed on the first surface.

* * * * *